US006798325B2

(12) United States Patent
Bach et al.

(10) Patent No.: US 6,798,325 B2
(45) Date of Patent: Sep. 28, 2004

(54) CONNECTOR RAIL MADE OF PROFILED SEMIFINISHED PRODUCTS FOR ELECTRICAL DEVICES AND APPLIANCES FOR VARIOUS NOMINAL CURRENTS

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/312,535

(22) PCT Filed: Jun. 18, 2001

(86) PCT No.: PCT/DE01/02267

§ 371 (c)(1),
(2), (4) Date: Dec. 27, 2002

(87) PCT Pub. No.: WO02/01585

PCT Pub. Date: Jan. 3, 2002

(65) Prior Publication Data

US 2003/0106876 A1 Jun. 12, 2003

(30) Foreign Application Priority Data

Jun. 28, 2000 (DE) ..... 100 32 654

(51) Int. Cl.[7] ..... H01H 1/00

(52) U.S. Cl. ..... 335/196; 200/237; 200/275; 218/22; 218/146

(58) Field of Search ..... 200/237–292, 200/51 R–51.17; 335/185–202; 218/22, 146; 361/648, 637

(56) References Cited

U.S. PATENT DOCUMENTS

| | | | | |
|---|---|---|---|---|
| 2,813,170 A | | 11/1957 | Horn et al. | 335/28 |
| 3,211,876 A | * | 10/1965 | Christian et al. | 200/293 |
| 4,802,059 A | * | 1/1989 | Prietzel et al. | 361/648 |
| 4,827,096 A | * | 5/1989 | Martinetti | 200/275 |

FOREIGN PATENT DOCUMENTS

| | | | |
|---|---|---|---|
| DE | 19643607 | 11/1997 | H01H/1/58 |
| DE | 19939710 | 2/2001 | H01H/1/58 |
| EP | 0743708 | 11/1996 | H01H/1/42 |

* cited by examiner

*Primary Examiner*—James R. Scott
(74) *Attorney, Agent, or Firm*—Harness, Dickey & Pierce, P.L.C.

(57) ABSTRACT

A connector rail includes a full profile which is provided with first bearing surfaces and second bearing surfaces which are used to provide support in the window opening of the rear wall of the housing. The second bearing surfaces are provided with projections for securing continuous current conductors which are aligned in a parallel manner and which are, for instance in the case of low voltage circuit breakers, embodied as male contacts for fixed contacts. Respectively corresponding projections are provided in order to secure the flexible cables to the moveable switching contacts or to secure the fixed switching contacts.

20 Claims, 2 Drawing Sheets

CONNECTOR RAIL MADE OF PROFILED SEMIFINISHED PRODUCTS FOR ELECTRICAL DEVICES AND APPLIANCES FOR VARIOUS NOMINAL CURRENTS

This application is the national phase under 35 U.S.C. § 371 of PCT International Application No. PCT/DE01/02267 which has an International filing date of Jun. 18, 2001, which designated the United States of America and which claims priority on German Patent Application number DE 100 32 654.4 filed Jun. 28, 2000, the entire contents of which are hereby incorporated herein by reference.

FIELD OF THE INVENTION

The invention generally relates to connecting bars made of profiled semifinished materials for the connection of the electrical components of electrical appliances and devices to an external circuit. Preferably, the connecting bars extend through window openings in the appliance or device wall and are fixed in the housing by a fastener.

BACKGROUND OF THE INVENTION

On the part of a connecting bar led through out of the housing to the outside, an equipment-side power feeding bar, for example, or some other suitable connecting element for supplying energy can be connected in this way. The connecting bar is in this case generally arranged securely in the insulating wall body of an appliance or device, which is generally implemented with the aid of lead-through openings and fastening elements.

The connecting bars, which preferably can be used for low-voltage power circuit breakers, must also be designed in such a way that they can be produced efficiently and are suitable for performing certain functions. These functions are: current-carrying capacity, heat dissipation, a surface for connections of power feeding bars and the absorption and transmission of static and dynamic forces. It is consequently a location which is highly stressed dynamically and in terms of force.

In addition, it is intended for it to be possible to accommodate connecting bars for different current intensities in a standard housing with standard lead-through openings. In conventional appliances and devices, bolts serve as fastening means for the connecting bars, the bolts extending through openings arranged transversely with respect to the longitudinal axis of the connecting bars and a nut thread generally being provided in the wall of the corresponding housing for receiving the bolts. For reasons of mechanical strength, metallic insert nuts or press-in nuts are used for this purpose in the case of a housing consisting of an insulating material.

The production and installation of connecting bars of this type consequently involves high material and production expenditure. It has therefore been proposed, for example in the case of low-voltage power circuit breakers, to use connecting bars which are sawn off from a profiled material with one or more projections, in such a way that the connecting bars are inserted through a hole and the projection or projections of the profiled material serve as stops of the connecting bar on the breaker housing and consequently form the power transmission of the switching forces to the housing (DE 196 43 607 A1). This has the effect in the case of switches of this type on the one hand that the position of the fixed contact with respect to the housing is determined and on the other hand the fastening location is relieved of the forces mentioned, with the result that here only a fixing force is required, but there is no loading by the shearing force and the positioning force.

A connecting bar of this type for a low-voltage power circuit breaker with a formed-on projection to overcome the aforementioned expenditure has been proposed in DE 196 43 607 A1. This connecting bar is inserted from inside through the lead-through opening of the housing wall and is supported on the housing rear wall by means of a projection. For the production of this connecting bar, special profiles which have an integrally formed-on strip are used, from which pieces which form the connecting bar are then cut off.

In the case of low-voltage power circuit breakers, it has previously been customary to use within a type series connecting bars of thicknesses varying according to the nominal currents. These connecting bars are likewise produced from profiles by sawing off. The housing has standard cutouts for the connecting bars, which are respectively designed for the greatest nominal current intensity. For thinner connecting bars of smaller nominal current intensities, spacers made of plastic which fill the intermediate spaces are used. The mounting of the spacers has the disadvantage of additional costs for these parts and higher assembly costs and they constitute a source of errors if assembly of the current tracks is performed by the customer.

In all these known electrical appliances and devices, the connecting bars are produced from solid material, irrespective of the production technology otherwise used. This means that the bars for different current intensities also have different cross sections and consequently different outer dimensions; a disadvantage which has already been dealt with above.

It has therefore already been proposed elsewhere to use for low-voltage power circuit breakers hollow connecting bars, which are produced from a hollow profile material by sawing off and may have both only one cavity and a plurality of cavities (DE Patent Application 199 39 710.4). In this case, these connecting bars have the same outer cross section for all different current intensities.

The current-carrying capacity is regulated by means of the wall thickness of the hollow bar which forms the conducting, current-carrying cross section. It follows from this that in the case of lower current intensities through lower wall thicknesses there is a larger inner cavity, or in the case of higher current intensities through thicker wall thicknesses there is a smaller inner cavity, which may continue up to a solid configuration without a cavity, in the case of the highest rated current intensity. As mentioned, the lead-through openings in the respective appliance and device housings are designed for the outer dimensions required for this highest rated current intensity. However, the production of hollow profiles of this type from several materials used with preference for the production of connecting bars of this type entails considerable difficulties.

In U.S. Pat. No. 2,813,170 A1, connecting bars which have a fork-like contour and are inserted from the inside through the rear wall of the breaker are shown. They are fastened to the rear wall of the breaker by means of bolts and the U shape with a broad base and the additional guidance of the U legs in the rear wall of the breaker serve here merely for secure contact retention to prevent tilting.

SUMMARY OF THE INVENTION

An object of an embodiment of the present invention is to design connecting bars in such a way that, even in the case of different nominal current values, they can be used without additional spacers in appliance and device housings with standard through-openings. As such, problems in the production of hollow semifinished profiles may be avoided.

This object may be achieved according to an embodiment of the invention by a connecting bar made of profiled semifinished materials, for electrical appliances and devices, for different nominal currents, for the connection of the electrical components of electrical appliances and devices to an external circuit. The connecting bars preferably extend through window openings in the appliance or device wall and are fixed in the housing by a fastener. The bar preferably includes a solid profile, and is provided with first bearing surfaces and second bearing surfaces to provide support in the window opening of the rear wall of the housing. The second bearing surfaces preferably each have a continuation to the external circuit and, depending on use as an upper or lower connecting bar of a low-voltage power circuit breaker, either a lug for securing the flexible stranded conductors to the movable switching contacts or a lug for securing the fixed switching contacts is provided.

The two continuations of the second bearing surfaces are aligned parallel to each other, and are preferably formed as isolating contacts for fixed counter-contacts. This produces a fork-like configuration. In this case, the first and second bearing surfaces are formed in such a way that, irrespective of the current-dependent material thickness of the solid profile, for all the current intensities they are always at the same distances from each other. This distance corresponds to the standard dimensions of the window openings in the rear wall of the housing and those of the counter-contacts. The first and second bearing surfaces advantageously extend from the solid profile to both sides. However, it may also be expedient for the first and second hearing surfaces to extend from the solid profile only to one side. For instance, it may be more favorable for the upper connecting bar for securing the fixed switching contacts if it is formed with bearing surfaces which extend only to one side, since in this case the lug for the fixed contact can be secured better. For the lower connecting bar, on the other hand, it is advantageous if it is provided with bearing surfaces which extend to both sides. Bores required for a fixed connection of the appliance to continuing current conductors are expediently punched.

BRIEF DESCRIPTION OF THE DRAWINGS

The invention is to be explained in more detail below for better understanding on the basis of a preferred exemplary embodiment, which does not restrict the extent of protection of the invention.

DETAILED DESCRIPTION OF THE PREFERRED EMBODIMENTS

Figure 1:
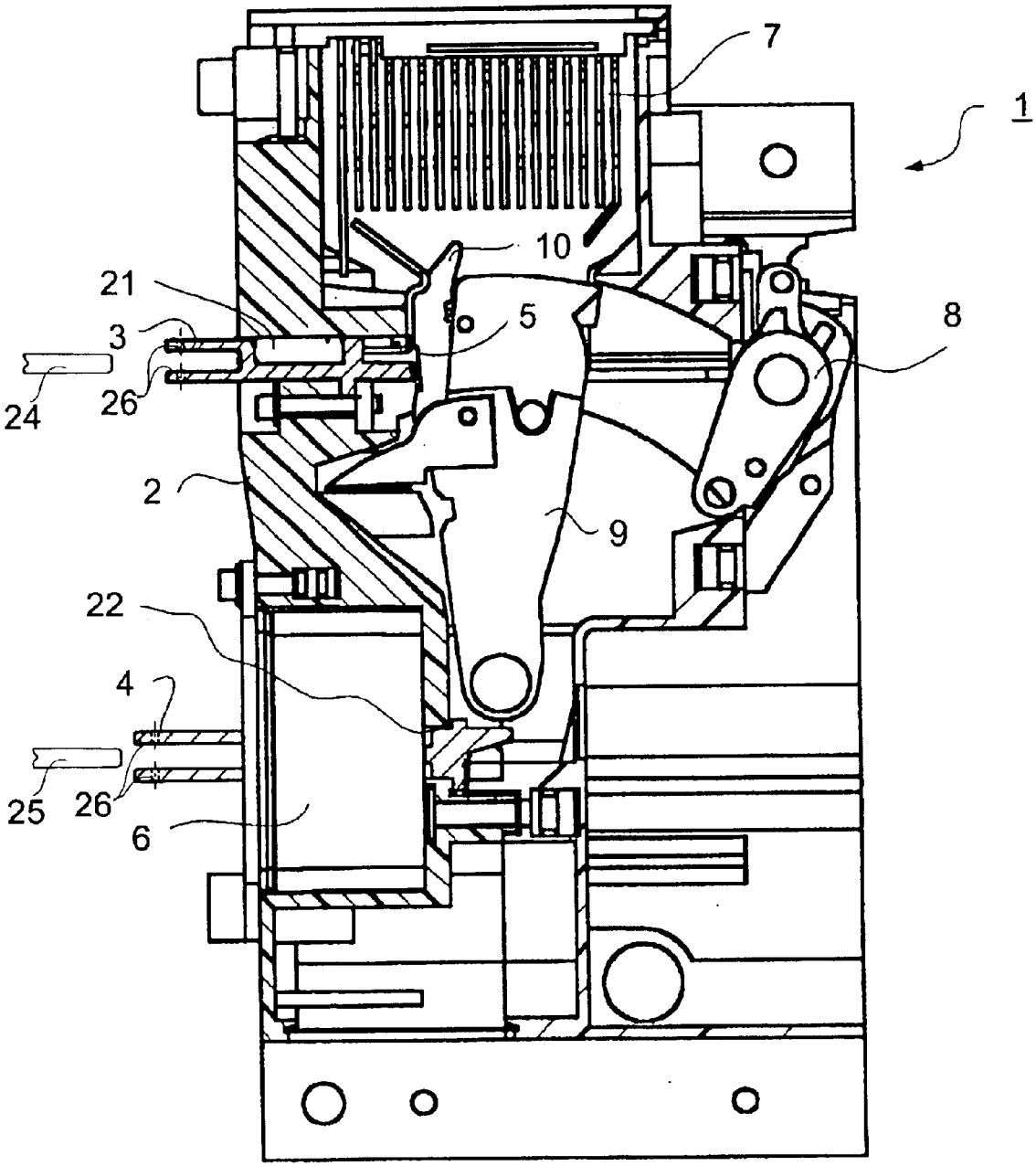
FIG. 1 schematically shows a low-voltage power circuit breaker in section.

In FIG. 1, a low-voltage power circuit breaker 1 is schematically represented in section. The upper connecting bar 3 and the lower connecting bar 4, which has been led through the current transformer 6, are led out through the window openings 21 and 22 in the rear wall 2 of the housing of the low-voltage power circuit breaker 1. The upper and low connecting bars 3, 4 are secured to respective fixed counter-contacts 24, 25 via bores 26. On the upper connecting bar 3, the fixed switching contact 5 is located, and, on the lower connecting bar 4, the movable switching contact 10, which is located on a contact carrier 9 connected to the breaker mechanism 8, is connected by flexible connections which are not represented. Arranged above the fixed switching contact 5 and the movable switching contact 10 is the arc quenching chamber 7.

Figure 2:
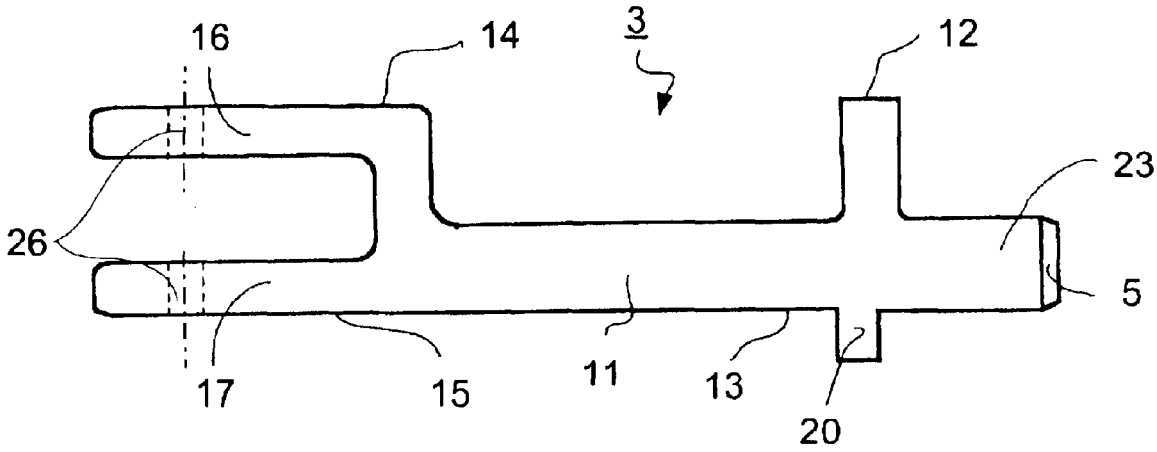
FIG. 2 shows a possible advantageous embodiment of an upper connecting bar according to the present invention in side view.

FIG. 2 shows a possible advantageous embodiment of an upper connecting bar 3 according to the present invention in side view. It is formed as a solid profile 11, which is provided with first bearing surfaces 12, 13 to provide support in the inner region of the window opening of the rear wall 2 of the housing and second bearing surfaces 14, 15 to provide support in the outer region of the window opening of the rear wall 2 of the housing, the latter bearing surfaces 14, 15 having continuations 16, 17 for securing the equipment-side bus bars, which at the same time are formed as isolating contacts into the fixed counter-contacts, for example isolating laminated contacts, of the switchgear. Bores 26 are illustrated for securing the continuing current conductors 16, 17, wherein the bores 26 are punched. In this embodiment, the bearing surfaces 13 and 15 on the underside of the upper connecting bar 3 are an integral part of the lower surface of the upper connecting bar 3. A lug 23 serves for securing the fixed switching contact 5. The first bearing surfaces 12, 13 and the second bearing surfaces 14, 15 are formed in such a way that, irrespective of the material thickness of the solid profile 11, for all current intensities they are always at the same distances from one another, which correspond to the standard dimensions of the window openings 21, 22 in the rear wall 2 of the housing and those of the fixed counter-contacts. The lug 20 serves for the axial arrestment of the upper connecting bar 3 on the breaker housing.

Figure 3:
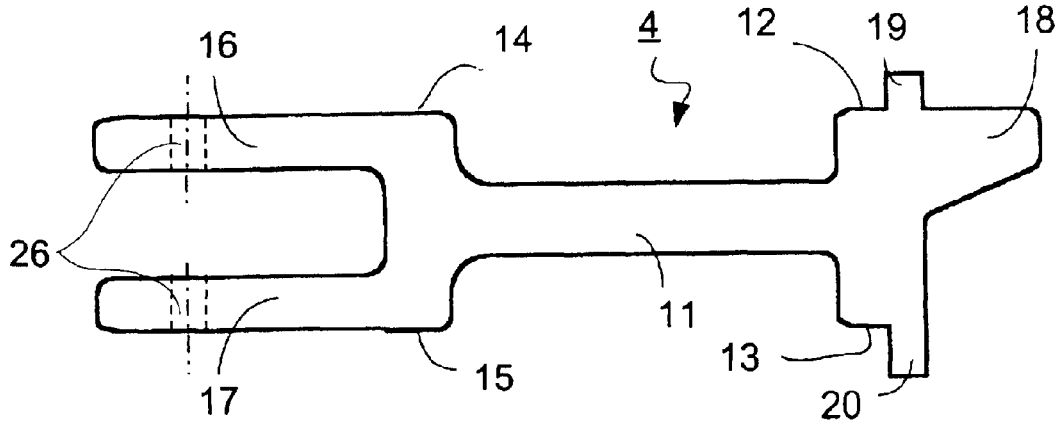
FIG. 3 shows a possible advantageous embodiment of a lower connecting bar according to the present invention in side view.

FIG. 3 shows a possible advantageous embodiment of a lower connecting bar 4 according to the present invention in side view. The same parts with the same functions are denoted by the same reference numerals as in FIG. 2. The lower connecting bar 4 is likewise formed as a solid profile 11, which is provided with first bearing surfaces 12, 13 to provide support in the inner region of the window opening of the rear wall 2 of the housing and second bearing surfaces 14, 15 to provide support in the outer region of the window opening of the rear wall 2 of the housing, the latter bearing surfaces 14, 15 having continuations 16, 17 for securing the equipment-side bus bars, which at the same time are formed as isolating contacts into the fixed counter-contacts, for example isolating laminated contacts, of the switchgear. Bores 26 are illustrated for securing the continuing current conductors 16, 17, wherein the bores 26 are punched. A lug 18 serves for securing the flexible stranded conductors to the movable switching contacts. The first bearing surfaces 12, 13 and the second bearing surfaces 14, 15 are formed in such a way that, irrespective of the material thickness of the solid profile 11, for all the current intensities they are always at the same distances from one another, which correspond to the standard dimensions of the window openings 21, 22 in the rear wall 2 of the housing and those of the fixed counter-contacts. The lugs 19, 20 are customary stops for the axial arrestment of the lower connecting bar 4 on the breaker housing.

The advantage of the solution according to an embodiment of the invention is that all further items, such as terminal screws, connecting bolts, isolating disconnect contacts, housing openings and the like, are the same for all current intensities. In the case of an outwardly open configuration, with reduced or variable cross section, the standard installation dimension is achieved by webs. The connecting bars are adaptable for the installation purpose as an upper or lower bar, because these have different additional functions (stranded conductor connection, contact retention).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connecting bar made of semifinished materials, for connection of at least one electrical component to an external circuit, the connecting bar extending through at least one window opening in a wall of at least one of an appliance and device housing the at least one electrical component, the connecting bar comprising:

a solid profile, including first bearing surfaces and second bearing surfaces to provide support in the window opening of the wall, the second bearing surfaces each having a continuation to the external circuit; and at least one of a lug for securing flexible stranded conductors to movable switching contacts and a lug for securing flexible stranded conductors to fixed switching contacts.

2. The connecting bar as claimed in claim 1, wherein two continuations are aligned parallel to each other and are formed as isolating contacts for fixed counter-contacts.

3. The connecting bar as claimed in claim 1, wherein the first bearing surfaces and the second bearing surfaces are formed such that, irrespective of current-dependent material thickness of the solid profile, for all current intensities they are always at the same distances from each other, which correspond to standard dimensions of the window openings in the rear wall of the housing and those of the counter-contacts.

4. The connecting bar as claimed in claim 1, wherein the first and second bearing surfaces extend from the solid profile to both sides.

5. The connecting bar as claimed in claim 1, wherein the first and second bearing surfaces extend from the solid profile only to one side.

6. The connecting bar as claimed in claim 1, further comprising: bores, within the continuations, for securing the continuations.

7. The connecting bar as claimed in claim 6, wherein the bores are punched in the continuations.

8. The connecting bar as claimed in claim 2, wherein the first bearing surfaces and the second bearing surfaces are formed such that, irrespective of current-dependent material thickness of the solid profile, for all current intensities they are always at the same distances from each other, which correspond to standard dimensions of the window openings in the rear wall of the housing and those of the counter-contacts.

9. The connecting bar as claimed in claim 2, wherein the first and second bearing surfaces extend from the solid profile to both sides.

10. The connecting bar as claimed in claim 2, wherein the first and second bearing surfaces extend from the solid profile only to one side.

11. The connecting bar as claimed in claim 2, further comprising: bores, within the continuations, for securing the continuations.

12. The connecting bar as claimed in claim 11, wherein the bores are punched in the continuations.

13. A connecting bar for connection of an electrical component to an external circuit, the connecting bar comprising:

a profile, including first and second bearing surfaces, providing support for the electrical component in a device housing, the second bearing surfaces each including a projection connecting to the external circuit; and at least one projection for securing at least one flexible cable to at least one of movable switching contacts and fixed switching contacts.

14. The connecting bar as claimed in claim 13, wherein two projections are aligned parallel to each other and are formed as isolating contacts for fixed counter-contacts.

15. The connecting bar as claimed in claim 13, wherein the first bearing surfaces and the second bearing surfaces are formed such that, irrespective of current-dependent material thickness of the solid profile, for all current intensities they are always at the same distances from each other, which correspond to standard dimensions of window openings in a rear wall of the housing and those of the counter-contacts.

16. The connecting bar as claimed in claim 13, wherein the first and second bearing surfaces extend from the profile to both sides.

17. The connecting bar as claimed in claim 13, wherein the first and second bearing surfaces extend from the profile only to one side.

18. The connecting bar as claimed in claim 13, further comprising: bores, within the continuations, for securing the continuations.

19. The connecting bar as claimed in claim 18, wherein the bores are punched in the continuations.

20. The connecting bar as claimed in claim 13, wherein the connecting bar is made of profiled semifinished materials.

* * * * *